US006941910B2

(12) United States Patent
Methley

(10) Patent No.: US 6,941,910 B2
(45) Date of Patent: Sep. 13, 2005

(54) ADJUSTABLE VALVE CONTROL SYSTEM WITH TWIN CAMS AND CAM LIFT SUMMATION LEVER

(75) Inventor: Ian Methley, Witney (GB)

(73) Assignee: Mechadyne PLC, Oxford (GB)

( * ) Notice: Subject to any disclaimer, the term of this patent is extended or adjusted under 35 U.S.C. 154(b) by 0 days.

(21) Appl. No.: 10/487,173

(22) PCT Filed: Aug. 16, 2002

(86) PCT No.: PCT/GB02/03804

§ 371 (c)(1),
(2), (4) Date: Feb. 17, 2004

(87) PCT Pub. No.: WO03/016684

PCT Pub. Date: Feb. 27, 2003

(65) Prior Publication Data

US 2004/0200446 A1 Oct. 14, 2004

(30) Foreign Application Priority Data

Aug. 18, 2001 (GB) ..... 0120209

(51) Int. Cl.[7] ..... F01L 1/34
(52) U.S. Cl. ..... 123/90.16; 123/90.15; 123/90.31; 123/90.17

(58) Field of Search ..... 123/90.16, 90.15, 123/90.17, 90.31

(56) References Cited

U.S. PATENT DOCUMENTS 5,931,124 A * 8/1999 Kerkau et al. ..... 123/90.15
6,314,926 B1 * 11/2001 Meneely et al. ..... 123/90.16
6,321,704 B1 * 11/2001 Church et al. ..... 123/90.16

FOREIGN PATENT DOCUMENTS

GB 2180597 A * 4/1987 ..... F01L/1/12
GB 2206647 A * 1/1989 ..... F02D/13/02

* cited by examiner

*Primary Examiner*—Thomas Denion
*Assistant Examiner*—Zelalem Eshete
(74) *Attorney, Agent, or Firm*—Smith-Hill and Bedell

(57) ABSTRACT

A control system is disclosed for operating an engine valve. The system comprises two cams arranged on a common camshaft but rotatable relative to one another. A summation lever has cam followers in contact respective cams. The summation lever is movable in proportion to the instantaneous sum of the lifts of the respective cams. Rockers are provided for opening the engine valve in dependence upon the movement of the summation lever. By varying the phase of the cams relative to one another, it is possible to vary the valve timing, valve lift and/or valve event duration.

13 Claims, 6 Drawing Sheets

ADJUSTABLE VALVE CONTROL SYSTEM WITH TWIN CAMS AND CAM LIFT SUMMATION LEVER

CROSS REFERENCE TO RELATED APPLICATIONS

This is a national stage applications filed under 35 USC 371 based on International Application No. PCT/GB2002/03804 filed Aug. 16, 2002. This application claims priority under 35 USC 119 of British Patent Application No. 0120209.2 filed Aug. 18, 2001.

The invention relates a control system for operating an engine valve, which comprises two cams, a summation lever having cam followers in contact with both cams, the summation lever being movable in proportion to the instantaneous sum of the lifts of the respective cams, and a valve actuator serving to open the engine valve in dependence upon the movement of the summation lever, the valve timing, valve lift and valve event duration being dependent upon the phases of the two cams.

The opening characteristic of the valves of a combustion engine has considerable influence on its power, toxic emissions and fuel consumption. The engine power, for example, cannot be optimised for the whole engine speed and load range using fixed valve opening characteristics. Thus, in an engine with fixed valve operation, a compromise must be reached which enables acceptable engine operation over the whole operating range.

Many devices are known which enable variable valve operation and thus result in an engine operation closer to its ideal valve opening characteristic. For example, camshaft phasing systems for use on automotive spark ignition engines are well developed. However, it is clear that increased variability of the opening characteristic, provides still further advantages. Systems with variation of valve lift, opening period and closing timing thus offer considerably more advantages than systems only having a single variable phase camshaft.

DE 196 00 535 discloses a valve control system with a valve lift which is continuously adjustable in operation, the system being particularly intended for the two inlet valves of each cylinder of a combustion engine. This known control system comprises a summation lever in the form of a rocker arm, which is pivotally connected to a pivotal lever via a bearing pin and rollers that are rotatably mounted at the end of the rocker arm. The rollers are contacted by different inlet cams arranged on separate camshafts. The roller motion resulting from the combination of the different cams is variable by rotating one camshaft relative to the other. Hydraulic lash adjusters, which are fixed relative to the engine at a point of support of the pivotal lever, are also arranged at the ends of the pivotal lever closest to the valve and have an external stop. One of the rollers is forced into contact with the associated intake cam due to the force of a compression spring.

With the above control system, it is possible to vary the valve timing, valve lift and/or valve event duration by varying the phase of the two cams relative to one another. However, this control system is not compact and its complexity makes it difficult to retrofit to an existing engine design, as it would require extensive modification to the remainder of the engine.

OBJECT OF THE INVENTION

The present invention seeks to provide a less complex and more compact valve control system which allows continuous adjustment of the valve lift.

SUMMARY OF THE INVENTION

In accordance with the present invention, there is provided a control system for operating an engine valve, which comprises two cams, a summation lever having cam followers in contact with both cams, the summation lever being movable in proportion to the instantaneous sum of the lifts of the respective cams, and a valve actuator serving to open the engine valve in dependence upon the movement of the summation lever, the valve timing, valve lift and valve event duration being dependent upon the phases of the two cams, wherein the two cams are mounted coaxially with one another.

By mounting the cams on a common camshaft, the construction complexity is reduced. The proposed system nevertheless still permits a change in valve lift, opening period and closing timing in a fixed relationship to each other by using conventional phase shifting mechanisms to alter the phases of the cams in relation to the engine operating cycle. Using this improved control, the engine torque and full load efficiency can be optimised over the whole engine speed range. The possibility of reducing the intake valve lift provides considerable advantages with part-load efficiency, since the engine power output can be regulated in this manner without the usual throttle plate(s) and associated losses. The invention is equally applicable to both intake and exhaust valves, but will be described as applied to the intake valves.

In the case of an engine having two inlet valves per cylinder, it is preferred for the summation lever to be connected by a pivot shaft to two valve actuating rockers each of which is pivotable at one end about a fixed pivot point and acts on a respective inlet valve at its other end, the two cams being arranged to cause rotation of the summation lever about the pivot shaft in opposite directions.

In a preferred embodiment of the invention, lash adjusters are provided for maintaining the cam followers in contact with the cams and a stop is provided externally of the lash adjusters to limit the stroke of the lash adjusters.

Many modern valve control systems use hydraulic lash adjusters to eliminate the effect of tolerances on the clearance when the valve is closed. In existing systems with variable valve lift, an adjustable stop for the pivotal lever is required to prevent the lash adjusters from expanding, unchecked, when the inlet valves are closed and when there is a clearance between one of the rollers and its inlet cam. In the case of the preferred embodiment, the ends of the pivot shaft extending beyond the rockers provide a precise location for limiting the expansion of the lash adjusters.

Advantageously, the brackets have both ends located by components fixed relative to the engine, and are adjustable at one end via an adjustment screw fixed relative to the engine. The adjustability of the brackets provides the possibility of adjusting the inlet valve lift of each cylinder and, thereby, its air flow. Thus, any non-uniformity in cylinder filling, particularly at low loads, which results in unstable running, can be reduced.

In the angular range in which the cam followers, which are preferably rollers, are in contact with the base circle of both inlet cams, the position of the summation lever is undefined. Thus, it is necessary to take steps to maintain contact between one of the rollers and the associated inlet cam in order to avoid any undesired noise. Preferably, this is achieved by means of torque springs which surround the pivot shaft and act between the summation lever and the rockers.

It is further advantageous for one of the two different inlet cams to be formed as a pair of cams that are fast in rotation with one another and axially straddle the other inlet cam, the two cams acting on two roller cam followers. Thus, a symmetrical and, therefore, relatively small loading of the summation lever is achieved.

In a preferred embodiment of the invention, the lash adjusters can be switched to spring into a recessed position in the cylinder head, for disabling of the valves. In this manner, intermittent valve disablement is possible which leads to a further improvement in part-load efficiency.

Valve disablement can alternatively be achieved by forming the summation lever in two parts which are independently pivotable but which, during normal operation, can be locked together.

BRIEF DESCRIPTION OF THE DRAWINGS

The invention will now be described further, by way of example, with reference to the accompanying drawings, in which.

DETAILED DESCRIPTION OF THE DRAWINGS

Figure 1:
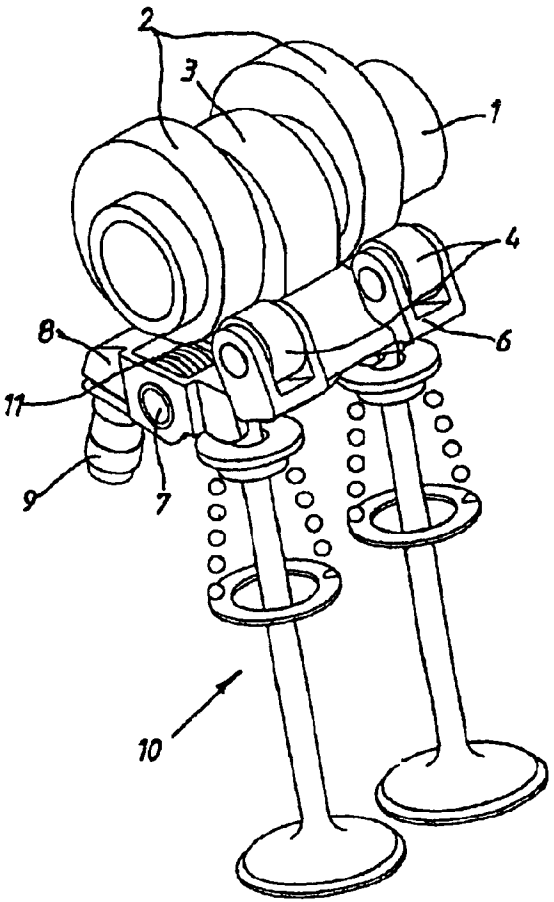
FIG. 1 is a perspective view of an engine valve control system of the present invention with lash adjusters fixed to the engine.
Figure 2:
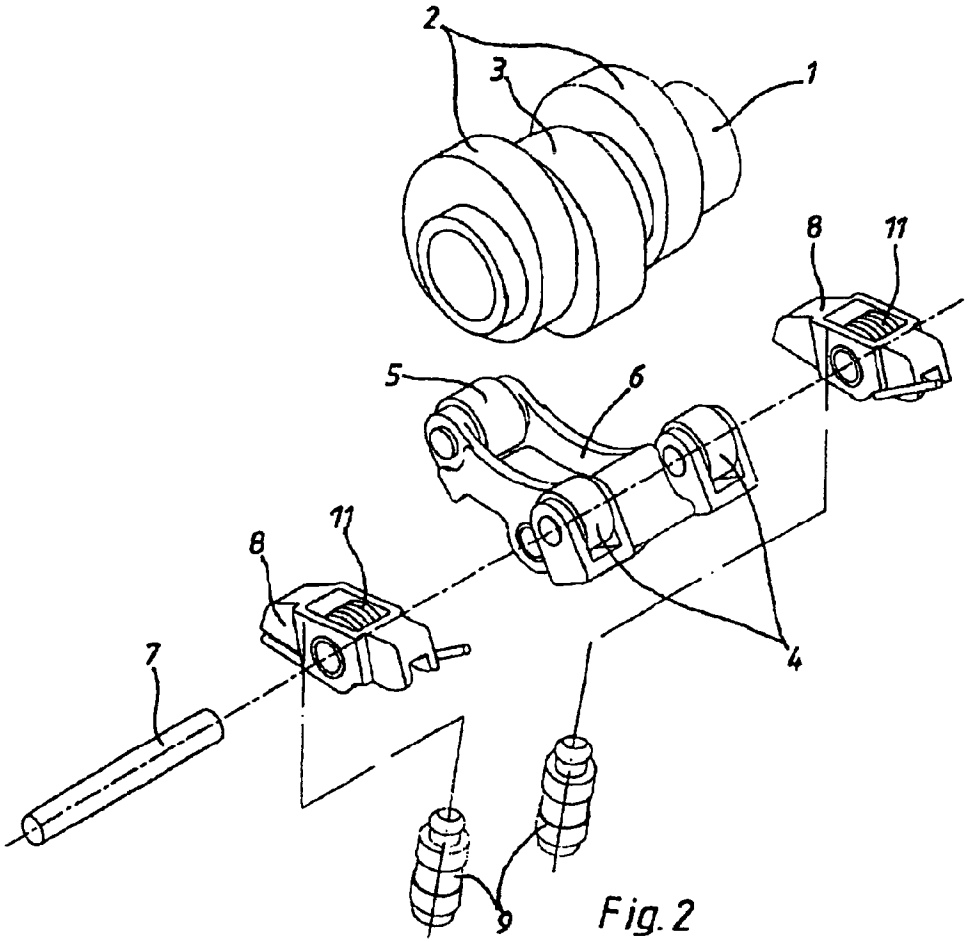
FIG. 2 shows the valve control system of FIG. 1 but in an exploded view.
Figure 10:
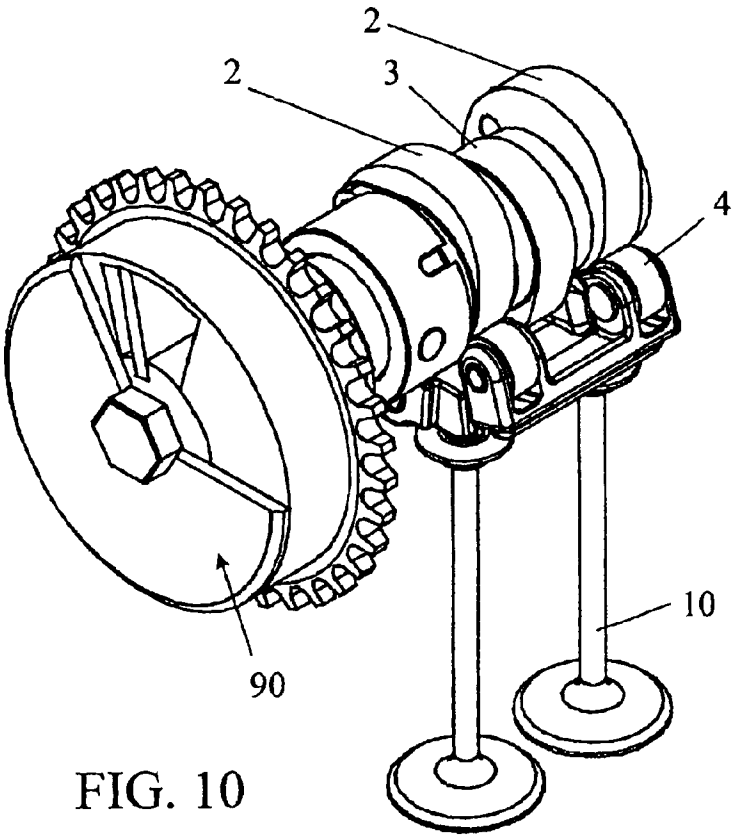
FIG. 10 is a perspective view of a valve control system of FIG. 1 also showing a phase shift mechanism incorporated into the drive socket that drives the camshaft from the engine crankshaft.

FIGS. 1 and 2 show a valve control system of a first embodiment of the present invention having a camshaft 1, on which are fitted a pair of first inlet cams 2 which straddle a second inlet cam 3 arranged axially between them. The two first cams 2 are fast in rotation with the camshaft, but the second cam 3 may rotate about the camshaft 1 relative to the first cams 2. The cams 2 and 3 are driven by the engine crankshaft through a phase change mechanism 90 incorporated in the drive socket of the camshaft (see FIG. 10). Phase shift mechanisms are themselves well known and need not therefore be described in detail in the present context.

The first inlet cams 2 act on two first cam follower rollers 4 and the second inlet cams 3 act on second rollers 5. The rollers 4, 5 are rotatably mounted on the end of a summation lever 6. The summation lever 6 is pivotally 35 connected to actuating rockers 8 via a pivot shaft 7. These are supported by one end on hydraulic lash adjusters 9, fixed to the engine while their opposite ends act on the inlet valves 10.

Torque springs 11 are arranged in the rockers 8 and around the pivot shafts 7. The torque springs 11 act between the rockers 8 and the summation lever 6 and thus cause the first rollers 4 to rest permanently against the first inlet cams 2.

Figures 3, 4:
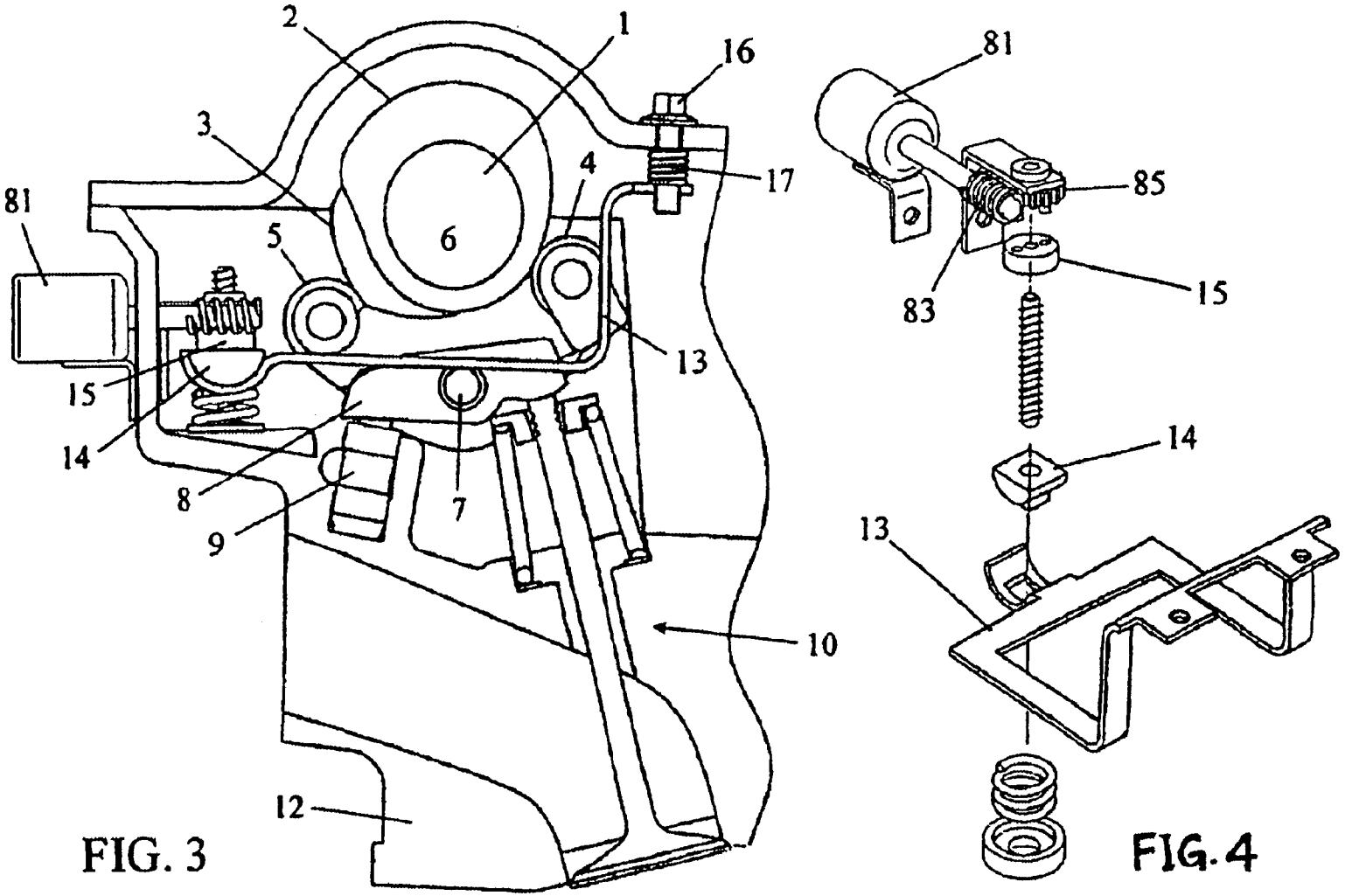
FIG. 3 is a schematic partial section through a cylinder head fitted with the valve control system of FIG. 1 and a remotely adjustable stop for the lash adjusters.
FIG. 4 shows an exploded view of the bracket that is used in FIG. 3 as the stop for limiting the stroke of the lash adjusters.

FIG. 3 shows a partial section through a cylinder head 12 fitted with the valve control system of FIGS. 1 and 2. FIGS. 3 and 4 also show a bracket 13 which acts as a stop for the extended pivot shaft 7. The bracket 13 is pivotally mounted on the cylinder head 12 at one end, by means of a bearing cup 14 and a nut 15, and, at the other end, is adjustable by means of positioning screws 16. Compression springs 17 surround the positioning screws 16 and act on the bracket 13, with pressure, to secure the positioning screws 16.

The position of the bracket 13 can be adjusted both manually by the means of the screws 16 and remotely by means of a motor 81 that can raise the pivoted end of the bracket 13. As can be seen from FIGS. 3 and 4, the bearing cup 14 is urged by a spring upwards as viewed against a nut 15 which is rotatable about a fixed screw by means of the motor 81, the spindle of the motor being coupled to the nut 15 by a worm wheel 83 and a pinion 85.

Figure 6:
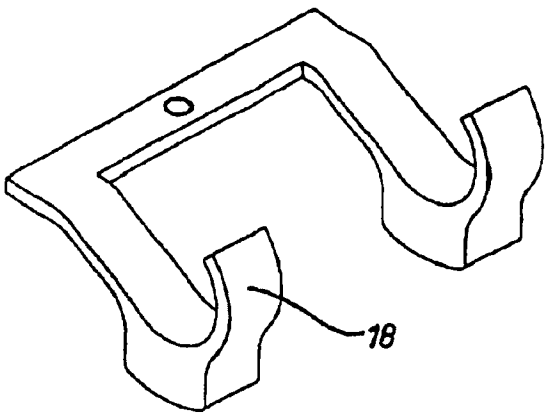
FIG. 6 is a perspective view of the alternative stop used in FIG. 5 to limit the stroke of the lash adjusters, FIG. 7 a perspective view of a further embodiment of a valve control system of the invention, with lash adjusters built into the actuating rockers and acting directly on the valve tips, FIG. 8 a partial section similar to that of FIG. 3 of the control system shown in FIG. 7, FIG. 9 an exploded view of the valve control of FIG. 7.
Figure 5:
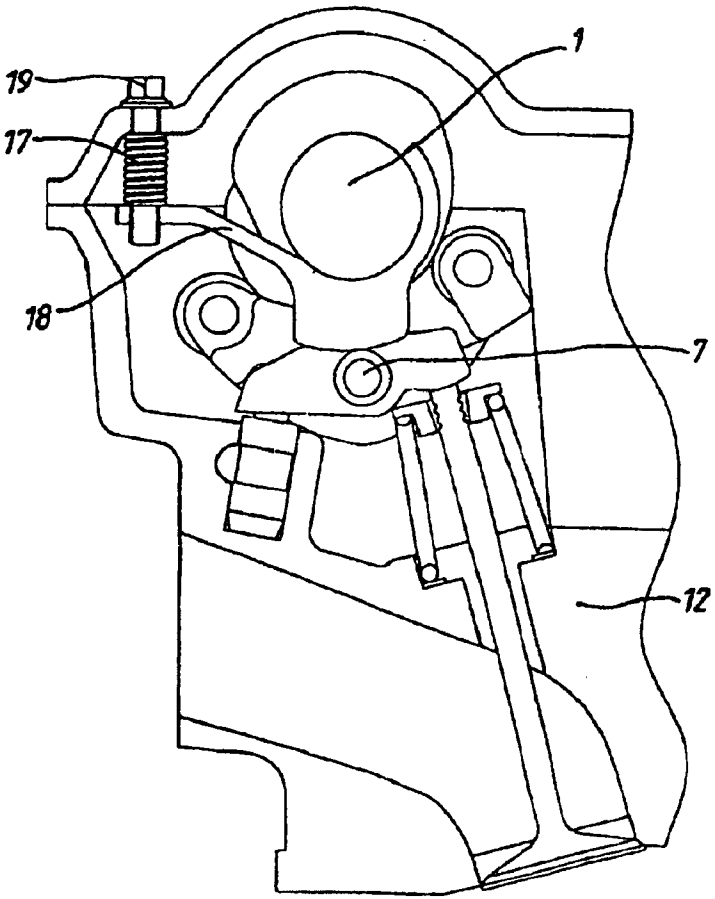
FIG. 5 is a partial section similar to that of FIG. 3, but showing an alternative design of stop for limiting the stroke of the lash adjusters.

FIG. 5 shows a similar partial section to that of FIG. 3 but with a different design of stop for the lash adjusters. In this case, the stop is in the form of a bracket 18, which is shown in FIG. 6 in a perspective view. This bracket 18 is supported on the base circle of the camshaft 1 and is adjustable at its free end by means of a positioning screw 19 which is secured by the compression spring 17. This bracket again serves as an adjustable stop for the extended pivot shaft 7. To permit adjustment by rotation of the stop by rotation of the bracket 18, it is important that the contoured stop surface of the bracket 18 in contact with the pivot shaft 7 should not be an arc of a circle centred on the axis of the camshaft.

To enable the position of the stops of the lash adjusters to be set remotely, it is possible to provide a remotely controlled motor, such as a stepper motor, to rotate the positioning screws 16 and 19.

Figure 8:
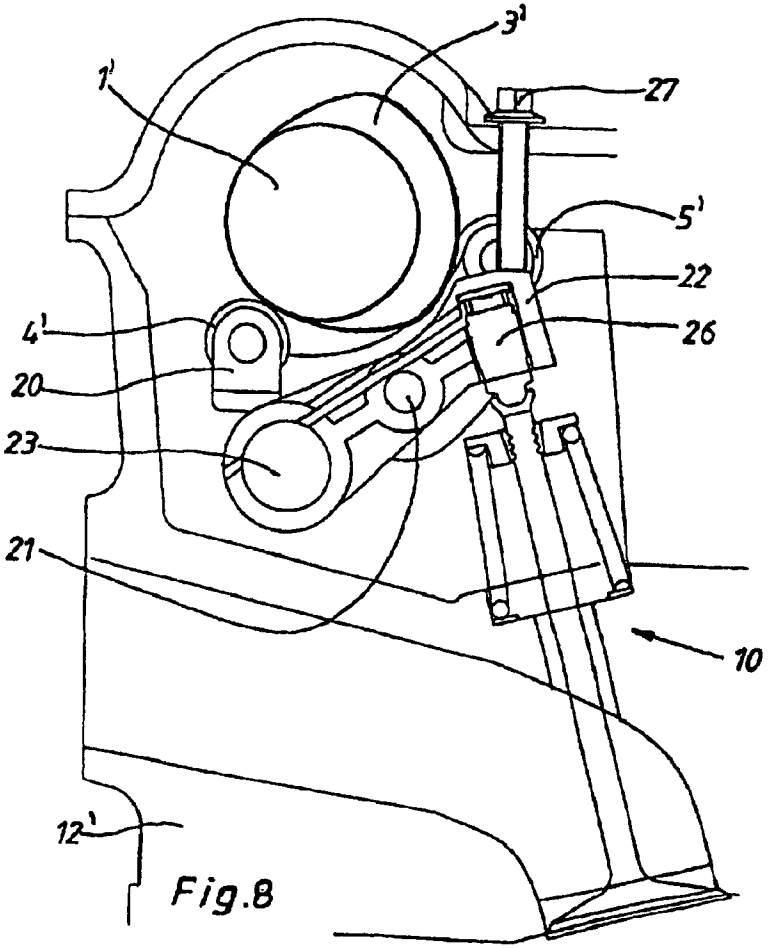
Figure 7:
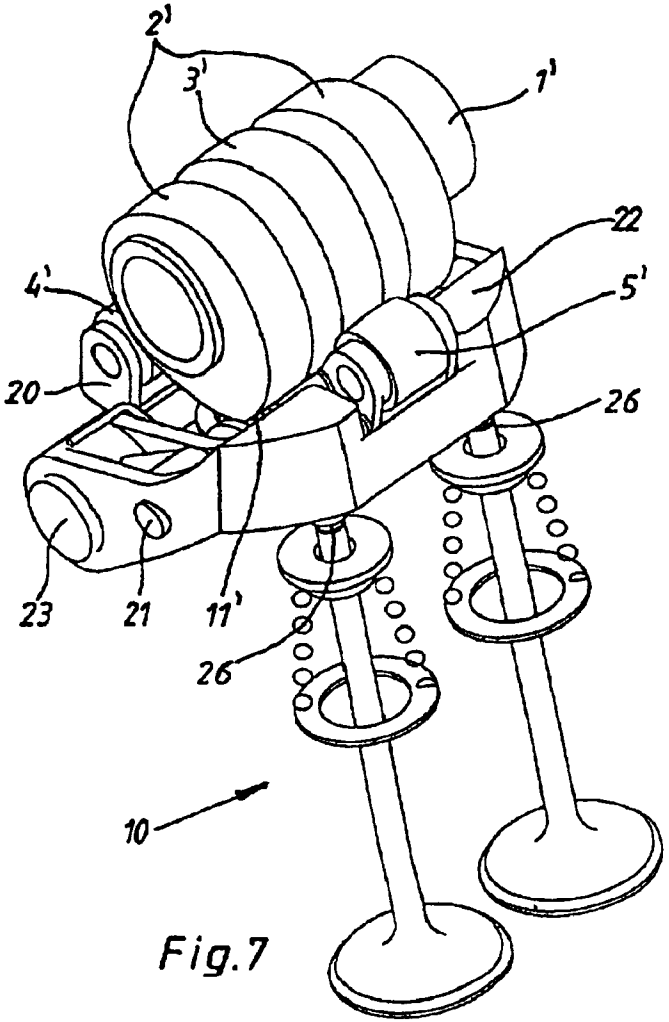
Figure 9:
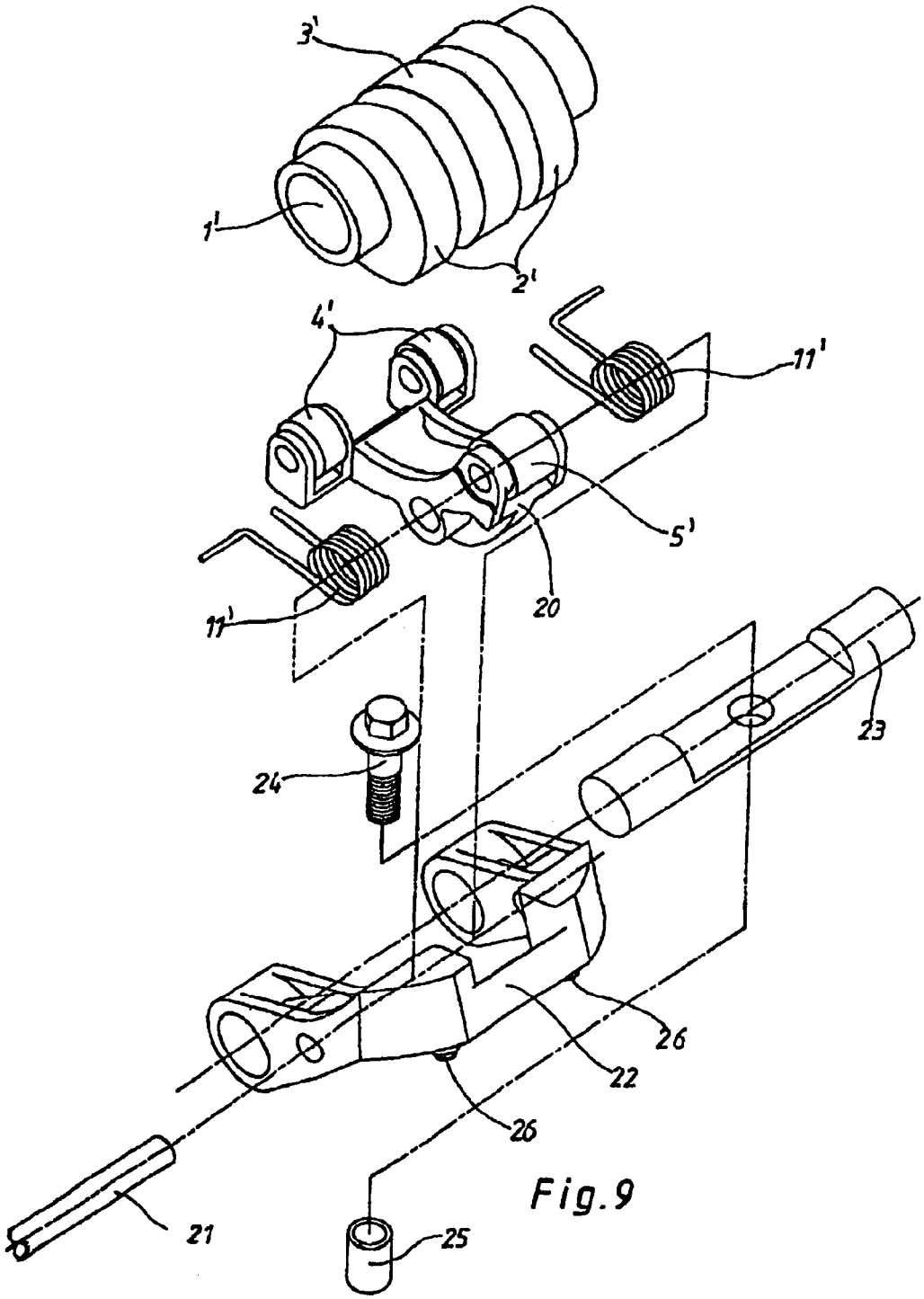

FIGS. 7 to 9 show a different embodiment of the valve control of the present invention with an adjustment camshaft 1', on which a pair of first inlet cams 2' are rotatably arranged and between these is a different individual second inlet cam 3'. The first inlet cams 2' are engaged by two first cam follower rollers 4' and the second inlet cam 3' by a second roller 5'. The rollers 4', 5' are rotatably mounted at the ends of a summation lever 20. The summation lever 20 is pivotally connected to an actuating rocker 22 via a pivot shaft 21. The actuating rocker 22 is pivotally mounted at one end about a shaft 23 which is fastened to the cylinder head 12' by means of a fixing screw 24 and a location dowel 25. At the other end of the actuating rocker 22 there are provided lash adjusters 26 which are in contact with the inlet valves 10.

Torque springs 11' are arranged between the summation lever 20 and the actuating rocker 22 and these surround the pivot shaft 21. The torque springs act between the actuating rocker 22 and the summation lever 20 and thus cause the first rollers 4' to rest permanently on the first inlet cams 2.

The described valve control systems of the invention operate as follows:

The movement of the inlet valve 10 is defined by two different inlet cams 2,2', 3,3' which are rotatably arranged opposite each other on the camshaft 1, 1'. The first inlet cam 2, 2' controls the opening characteristic of the inlet valve 10, while the second inlet cam 3, 3' controls the closing characteristic. The combination of the two cam profiles provides the effective cam profile. Thus by using a convention phase shifting mechanism to vary the phase of the cams relative to one another the event duration may be varied.

The inlet valves 10 are actuated from the rockers 8, 22. These are pivotally connected to the summation levers 6, 20 via a pivot shaft 7, 21. Rollers 4, 4', 5, 5' are rotatably mounted at the ends of the summation levers 6, 20 and are in contact with the different inlet cams 2, 2', 3, 3'. The pivot shaft 7, 21 is arranged between the rollers 4, 4', 5, 5'. The inlet valve lift is determined by the distance between the axis of the pivot shaft 7, 21 and the axis of the adjustable camshaft 1, 1' and this distance is determined by the inlet cams 2, 2', 3,3' acting in combination on the summation lever 6, 20.

Counter directional rotation of the inlet cams 2, 2' relative to inlet cams 3, 3' changes the valve lift characteristic. By moving the closing profile in the opening profile direction, the valve lift and length of time which the valve is open are reduced and by moving the closing profile in the counter direction, the valve lift and opening time are increased. The peak lift timing changes with the valve lift, but the start of opening can be held constant if the angular position of the opening cam to the crank shaft is held constant and hence only the closing cam controls the valve lift. Conversely, the closing time of the inlet valve 10 can be kept constant by a constant angular position of the closing cam relative to the crank shaft, while only the timing of the opening cams is varied.

The valve control system is arranged such that the inlet valves 10 remain closed as long as both inlet cams 2, 2',3, 3' have their rollers 4, 4', 5, 5' in contact with the base circle. The inlet valves 10 are then only lifted when both rollers 4, 4', 5, 5' are in contact with the lift profile of their inlet cams 2, 2', 3,3'. Valve opening begins when the closing cams are at maximum lift and the opening cams are at the beginning of their opening ramp. Closing of the inlet valve 10 begins when the rate of lift reduction on the closing cam 3,3' exceeds the rate of lift increase on the opening cams 2,2'.

In the region of the camshaft cycle where both rollers 4, 4', 5, 5' are touching the base circle of their inlet cams, the position of the summation levers 6, 20 is not defined. The torque springs 11,11' are necessary to hold one set of rollers 4, 4',5, 5' of the summation levers 6, 20, in contact with the corresponding opening or closing profile, during this unstable phase, so as to reduce valve operation noise.

The valve adjustment of the present invention provides, with comparatively small constructional complexity, the possibility of a simultaneous, continuous adjustment of valve lift and valve event duration while the engine is running, resulting in improved fuel efficiency and a reduction in noxious emissions.

It is possible to form the lash adjusters so that they can abruptly be retracted into a recessed position in the cylinder head, for disabling of the valves. In this manner, intermittent valve disablement is possible which leads to a further improvement in part-load efficiency.

Figure 11:
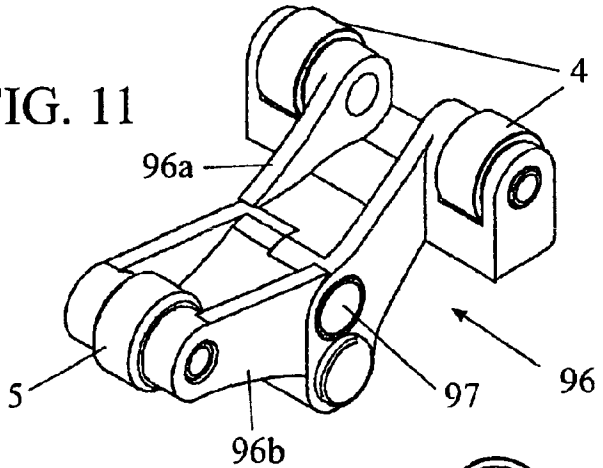
FIG. 11 is a perspective view of a modified summation lever which selectively lockable to enable and disable valve activation.
Figure 12:
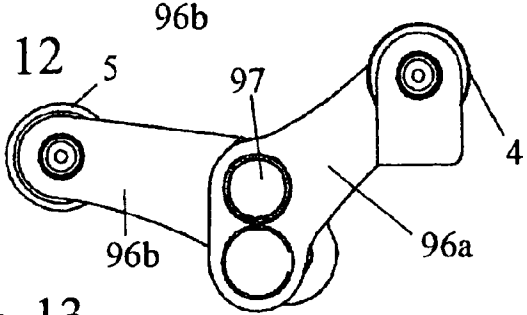
FIG. 12 is a side view of the summation lever in FIG. 11 when in an unlocked position for valve deactivation.
Figure 13:
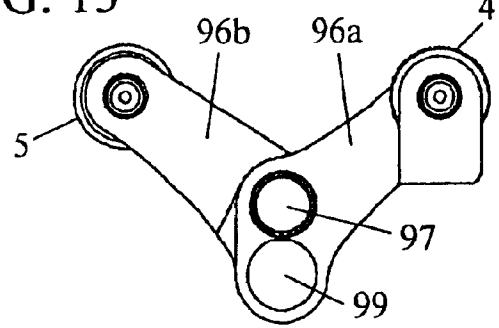
FIG. 13 is a view similar to that of FIG. 12 showing the summation lever in its locked position.

Valve disablement can alternatively be achieved by forming the summation lever in two parts which are independently pivotable but which, during normal operation, can be locked together. Such a summation lever is shown in FIGS. 11 to 13. The summation lever 96 in these drawings is formed by a first part 96*a* that carries the cam follower rollers 4 and a second part 96*b* that carries the cam follower roller 5. The two parts can pivot independently about a pivot shaft 97, in the manner shown in FIG. 12 or they may be locked to one another by means of a pin 99 in the manner shown in FIG. 13 so that they move in unison.

When the two parts 96*a* and 96*b* are locked to one another, the summation lever operates in the same manner as the one piece summation lever described previously with reference to FIG. 1. On the other hand, when the pin 99 is released to disengage the two parts from one another, then the action of the cams will be simply to pivot the two parts 96*a* and 96*b* about the shaft 97 without displacing the pivot shaft 97 and therefore without actuating the valves.

What is claimed is:

1. A control system for operating a valve of an engine having a crankshaft, which system comprises two cams mounted for rotation about a common axis, a summation lever extending transversely to the axis of rotation of the cams and having cam followers contacting the two cams on opposite sides of the axis of the cams, the summation lever being movable in proportion of the instantaneous sum of lifts of the in dependence upon the movement of the summation lever, wherein the phases of the two cams are adjustable independently of one another in relation to the phase of the engine crankshaft in order to vary the timing, the lift and the duration of a valve event.

2. A control system as claimed in claim 1 for an engine having two inlet valves per cylinder, wherein the summation lever is connected by a pivot shaft to two valve actuating rockers each of which is pivotable at one end about a fixed pivot point and acts on a respective inlet valve at its other end, the two cams being arranged to cause rotation of the summation lever about the pivot shaft in opposite directions.

3. A control system as claimed in claim 2, wherein lash adjusters are provided at the fixed pivot points for maintaining the cam followers in contact with the cams and a stop is provided externally of the lash adjusters to limit the stroke of the lash adjusters.

4. A control system as claimed in claim 3, wherein the stop is formed as a bracket of which one end is mounted for pivotal movement about a first point relative to the engine and the other end is provided with an adjustable positioning screw.

5. A control system as claimed in claim 4, wherein the stop is formed of a bracket that rests on the camshaft out of contact with the cams and has a contoured stop surface for limiting movement of the pivot shaft.

6. A valve controller according to claim 4, wherein a remotely controlled motor is provided for adjusting the position of the bracket.

7. A control system as claimed in claim 2, wherein biasing means are provided to maintain contact between the cam followers and the cams.

8. A control system as claimed in claim 7, wherein the biasing means comprise torque springs which surround the pivot shaft and act between the summation lever and the rockers.

9. A control system as claimed in claim 2, wherein the two different inlet cams are formed as a pair of cams that are fast in rotation with one another and axially straddle the other inlet cam, the two cams acting on two cam followers.

10. A control system as claimed in claim 1, wherein the cam followers are rollers.

11. A control system as claimed in claim 3, wherein the lash adjusters are formed in such a manner that they may be retracted into a recessed position in the cylinder head, for disabling of the valves.

12. A control system as claimed in claim 1, wherein the summation lever is formed in two parts which are independently pivotable to permit valve disablement but which can be locked together during normal engine operation.

13. A control system as claimed in claim 1, further comprising a phase shift mechanism for varying the phase of the two cams relative to the crankshaft of the engine independently of one another so as to permit variation of the phase, lift and duration of the valve events.

* * * * *